United States Patent [19]

Kahn

[11] Patent Number: 4,928,264

[45] Date of Patent: May 22, 1990

[54] NOISE-SUPPRESSING HYDROPHONES

[75] Inventor: Manfred Kahn, Alexandria, Va.

[73] Assignee: The United States of America as represented by the Secretary of the Navy, Washington, D.C.

[21] Appl. No.: 373,979

[22] Filed: Jun. 30, 1989

[51] Int. Cl.[5] ..... H04R 17/00

[52] U.S. Cl. ..... 367/141; 367/157; 367/901; 310/337; 310/316; 310/800; 381/94

[58] Field of Search ..... 367/1, 157, 131, 901, 367/141; 340/850; 181/206, 284, 296; 310/337, 316, 800, 320, 334; 381/94, 57, 86, 124

[56] References Cited

U.S. PATENT DOCUMENTS

| | | | |
|---|---|---|---|
| 4,025,724 | 5/1977 | Davidson, Jr. et al. | 310/337 |
| 4,232,381 | 11/1980 | Rennick et al. | 367/135 |
| 4,354,132 | 10/1982 | Borburgh et al. | 310/334 |
| 4,390,976 | 6/1983 | Eynck | 310/337 |
| 4,686,409 | 8/1987 | Kaarmann et al. | 310/334 |
| 4,695,988 | 9/1987 | Banno | 310/800 |

*Primary Examiner*—Charles T. Jordan
*Assistant Examiner*—J. Woodrow Eldred
*Attorney, Agent, or Firm*—Thomas E. McDonnell; George Jameson

[57] ABSTRACT

A hydrophone mounted on the hull of a ship comprises an electromechanical transducer made of void-containing ceramic material having a high piezoelectric sensitivity to water-borne acoustic sound signals, a transducer made of solid ceramic material having a low piezoelectric sensitivity to hydrostatic acoustic signals, both transducers having similar piezoelectric sensitivity to shipboard noise transmitted via the ship's hull and transducer mounting; and means for sensing and manipulating voltage signals generated in response to water-borne acoustic signals and mount-transmitted shipboard noise such that the mount transmitted noise signals are largely cancelled out and a relatively noise-free signal representing hydrostatically transmitted sound is obtained.

12 Claims, 2 Drawing Sheets

NOISE-SUPPRESSING HYDROPHONES

BACKGROUND OF THE INVENTION

1. Field of the Invention

This invention relates to a hydrophone mounted on the hull of a ship, and associated equipment on board ship, for detecting, measuring, recording, and listening to sound signals received from distant sound sources under water. More specifically, the invention relates to ceramic hydrophone transducers with associated electrical and electronic components which generate a voltage signal in response to underwater acoustic sound signals received from distant sources in which the noise generated on board ship and transmitted to the hydrophone via the ship's hull and the hydrophone mounting structure is suppressed.

2. Description of Prior Art

Hydrophones and related equipment for underwater detection of sound, such as the sound generated by submarines, as well as the suppression of such sound, have been the subject of much research effort. Noise transmitted by the hull of a ship to a transducer has been minimized by placing the transducer in an evacuated casing (U.S. Pat. 3,115,616). Laminated acoustic panels have been proposed for absorbing sound in water and elsewhere (U.S. Pat. Nos. 3,215,225, 3,923,118, 3,647,022, and U.S. Pat. No. 3,614,992). The frequency response of a hydrophone transducer has been improved by negative feedback to the transducer via a feedback electrode (U.S. Pat. No. 4,709,360). Noise transmission from a ship's hull to a hydrophone mounted on the hull has been minimized by using flexible supports and attaching heavy masses to the hydrophone so as to dampen out noise from the ship transmitted to the hydrophone via its support.

SUMMARY OF THE INVENTION

It has now been found that shipboard noise transmitted via the ship's hull and the hydrophone mount, which interferes with the detection of acoustic sound signals transmitted through the water from distant sound sources, can be minimized by electronic means. It is the object of this invention to provide a compact, effective hydrophone with associated equipment for detecting, measuring, recording and listening to sound signals under water in which the noise generated on board ship and transmitted via the ship's hull and hydrophone mounting structure is suppressed, such that water-borne acoustic signals from distant sources can be isolated in an improved manner.

This objective is realized by two types of electromechanical transducers coupled together mechanically and electrically, one such transducer having voids and being sensitive to hydrostatic acoustic signals, the other such transducer not having voids and being relatively insensitive to hydrostatic acoustic signals, both types of transducers being about equally sensitive to mount-transmitted ship's noise. The noise-related electrical output signals generated by the two types of transducers are therefore virtually identical; they are combined so as to cancel each other, so that the net voltage signal generated by the transducers represents predominantly the acoustic signal received by the transducers through the water.

DETAILED DESCRIPTION OF PREFERRED EMBODIMENT OF THE INVENTION

Figure 1:
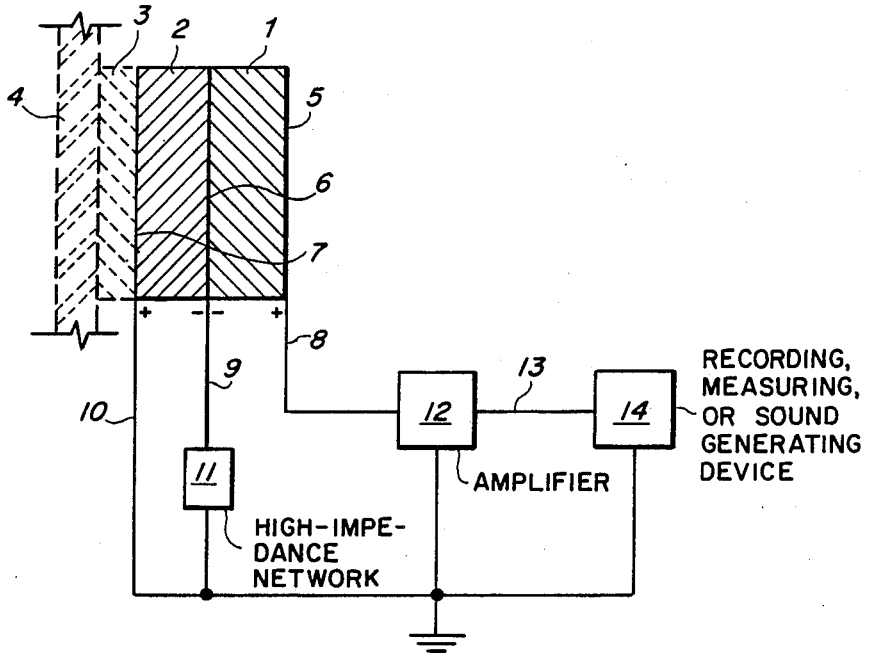
FIG. 1 is a schematic view of a first embodiment of this invention.

Water-borne sound signals from distant sources (hereafter referred to as "hydrostatic acoustic" signals) compress an electromechanical transducer element from all directions. A flat disc or plate of ceramic transducer material mounted on a ship's hull and immersed in water thus receives acoustic compressive forces both normal or perpendicular, to its flat faces as well as in a lateral direction, i.e. parallel to the flat faces of the transducer disc or plate. In a solid transducer element, the electromechanical response due to normal compressive forces is largely cancelled out by that due to the lateral compressive forces. As a result, the electromechanical, or piezoelectric, sensitivity of a solid ceramic transducer element to acoustic sound signals is very low.

On the other hand, void-containing ceramic transducers in the shape of flat discs or plates, having regularly spaced voids of uniform size respond differently to acoustic sound. The electromechanical response to normal compressive forces in such ceramics is reduced only to a minor degree by the effect of lateral compressive forces. As a result, porous ceramic transducer elements mounted on a ship's hull have a high electromechanical sensitivity to hydrostatic acoustic sound signals.

Noise from the ship transmitted via the hull and mounting structure to a flat transducer element induces only normal compressive stresses, i.e. normal to the flat face of the transducer disc. It produces no simultaneous lateral stresses, as do acoustic sound signals due to hydrostatic forces. Void-containing and solid ceramic transducer materials have approximately equal electromechanical sensitivity to normal stresses and thus to noise transmitted to the transducers via the ship's hull and the mounting structure supporting the transducer.

When void-containing and solid ceramic transducers in the shapes of flat discs or plates are mounted on a ship's hull, immersed in water, and exposed to both hydrostatic acoustic sound signals transmitted through the water and noise transmitted through the hull and mounting structure, it is found that there is generated across the void-containing ceramic transducer a first voltage signal in which both the hydrostatic acoustic signal and the ship noise are represented. At the same time, it is found that across the solid ceramic transducer, there is generated a second voltage signal which represents mostly ship noise and only very little hydrostatic acoustic signal owing to the insensitivity of the solid ceramic layer to hydrostatic acoustic signals. By taking the difference between these two voltage signals, one may obtain a net voltage signal in which the mount-transmitted ship noise signal is being largely cancelled out, leaving a signal representing the hydrostatic acoustic signal transmitted through the water with at most a minor mount-transmitted ship noise component.

The two types of ceramic transducer discs or plates—void-containing and solid—are typically about 2.5 mm thick and 10–15 mm in diameter. The voids in the ceramic transducers are in the shape of square, rectangular or circular void spaces about 10–20 microns thick, about 0.25 to 1 mm in diameter or width, arranged in planes parallel to the flat face of the transducer disc. They are regularly spaced within each plane on square or equilateral triangular centers with 0.5 to 1.25 mm spacing. The planes are spaced 20 to 100 microns apart in a direction normal to the flat face of the transducer disc. Void volume ranges from 5 to 20 percent, 8 to 15 percent being preferred. The solid transducer may contain up to about 2 volume percent of randomly distributed, mostly spherical pores; however, the ratio of void volume between the void-containing and the solid transducer should be greater than about 10. This generally produces a hydrostatic sensitivity ratio of at least 3:1. The preferred hydrostatic sensitivity ratio is at least 5:1. Hydrostatic sensitivity can be reported as the hydrostatic charge coefficient, $d_H$, that is measured in units of coulomb per newton or as the hydrostatic voltage coeficient, $G_H$, which is measured in units of volt-meter per newton.

If the materials of the two disc are different, the desired difference in higher hydrostatic sensitivity can be attained with a lower void volume ratio.

The polarity of the transducers determines which face becomes positive and which face becomes negative under mechanical compression; it is determined before use by "pling" the device, i.e. by imposing a D.C. voltage gradient of about 3 kV per mm of transducer thickness across the transducer at approximately 130 degrees C.

A typical ceramic material exhibiting the piezoelectric properties described above consists of $PbO(ZrO_2)_x(TiO_2)_{(1-x)}$, x ranging from 0.5 to 0.54, typically being 0.52. It is sometimes doped with one to 3 weight percent of niobium pentoxide, $Nb_2O_5$. This material is then still referred to as PZT. Other examples of piezoelectric materials are PZLT, consisting of PZT doped with 6–15 weight percent of lanthanum oxide, $La_2O_3$; barium titanate, $BaTiO_3$; lead-zinc-niobium oxide, PZN, consisting of PbO, ZnO and $Nb_2O_5$ in approximately 1:1:1 molar ratio; and electrostrictive ceramics such as lead-magnesium-niobium oxide, $PbO(MgO)_{0.33}(Nb_2O_5)_{0.33}$.

The electromechanical response to mount-transmitted ship noise, being the result of normal, unidirectional compressive forces, should be substantially equal in amplitude for both the void-containing and the solid transducers, so that the mount-transmitted noise-related voltage components can be combined in such manner as to cancel each other out. This object may be enhanced by appropriately selecting the relative thicknesses of the transducer discs or plates since the electromechanical response of voltage to mechanical stress is directly proportional to the thickness of the transducer disc or plate. Alternatively, if the mount-transmitted ship noise-related voltage signals from the two transducers are not of equal amplitude, adjustments may be made electronically to equalize and cancel the two signals, e.g. by a network of two resistors proportional to the different electromechanical responses of the the transducers or adjusting the gain of the amplifiers.

With reference to FIG. 1, a void-containing ceramic transducer 1 in the shape of a flat disc or plate, and a solid ceramic transducer 2 of similar shape, are disposed between electrodes 5, 6, and 7, with intimate and electrical contact between the faces of the ceramic transducers and the electrodes.

The assembly of electrodes and transducers is affixed to a mounting structure 3 which in turn is mounted on the outside of the hull 4 of a ship. The assembly of transducers and electrodes is under water. The electrode 5 is attached to the void-containing transducer on the side facing into the water. The electrode 6 is embedded between the transducers 1 and 2. The electrode 7 is attached to the solid transducer 2 as well as the mounting structure 3, with electrical contact to the transducer but without electrical contact to the mounting structure 3 and hull 4. The orientation of the two ceramic transducers is such that like polarities are in contact with electrode 6. In FIG. 1, the negative faces of the two transducers are shown connected to electrode 6. Alternatively, the positive faces of the two transducers could be connected to electrode 6.

The two transducer discs or plates may be closely coupled by a thin layer of adhesive. Alternatively, they may be fused together at an elevated temperature with an intervening thin metal layer at their faces. As a further alternative, a single disc or plate of ceramic transducer material may be manufactured having a solid zone, a thin, built-in metal layer and a zone containing voids.

The electrodes in contact with the transducer discs or plates, or embedded between them, must be tightly attached to make good electrical contact with the transducer material.

Normal compressive stresses induced by shipboard noise transmitted to the transducers via the mounting structure generate noise-related voltage signals between the electrodes 7 and 6 and between the electrode 6 and 5 which are close in magnitude and of opposite sign. The net mount-transmitted ship noise-related voltage signal across electrodes 5 and 7 thus is virtually zero. Acoustic sound signals transmitted hydrostatically through the water, on the other hand, produce a substantial voltage signal only across the void-containing transducer and hence across electrodes 5 and 6. The hydrostatically induced voltage signal across the solid transducer is very low. The overall voltage across electrodes 5 and 7 thus has a strong hydrostatically induced voltage signal component.

The electrodes 5, 6, and 7 are connected to electrical leads 8, 9, and 10, respectively. These leads are brought inside the ship (details not shown). Lead 10 is grounded. Lead 9 is connected to ground via a high-impedance network 11, e.g. a parallel resistor-capacitor network with a resistance of not less than 10 meg ohms and a capacitance of 0–25 picofarads. Alternatively, lead 9 and impedance 11 are omitted and the voltage at the interface between the transducer elements 1 and 2 is allowed to float. Electrode 6 is needed for initial poling.

It is thus seen that the voltage signal across leads 8 and 10 will be composed of two components: (1) the hydrostatically induced signal generated by the void-containing ceramic transducer 1, which is opposed by a negligibly small hydrostatically induced voltage generated in the solid ceramic transducer 2, and (2) a voltage proportional to the mount-transmitted ship noise signals generated across the two transducers which oppose each other, leaving only a negligibly small mount-transmitted ship noise component in the net voltage signal across leads 8 and 10.

The voltage signal across leads 8 and 10 is received by detecting means 12, an amplifier, whose output is transmitted via lead 13 to a recording, measuring or sound generator device 14. Signal-to-noise improvements of 2–3 decibels are achieved with the apparatus described.

Figure 2A:
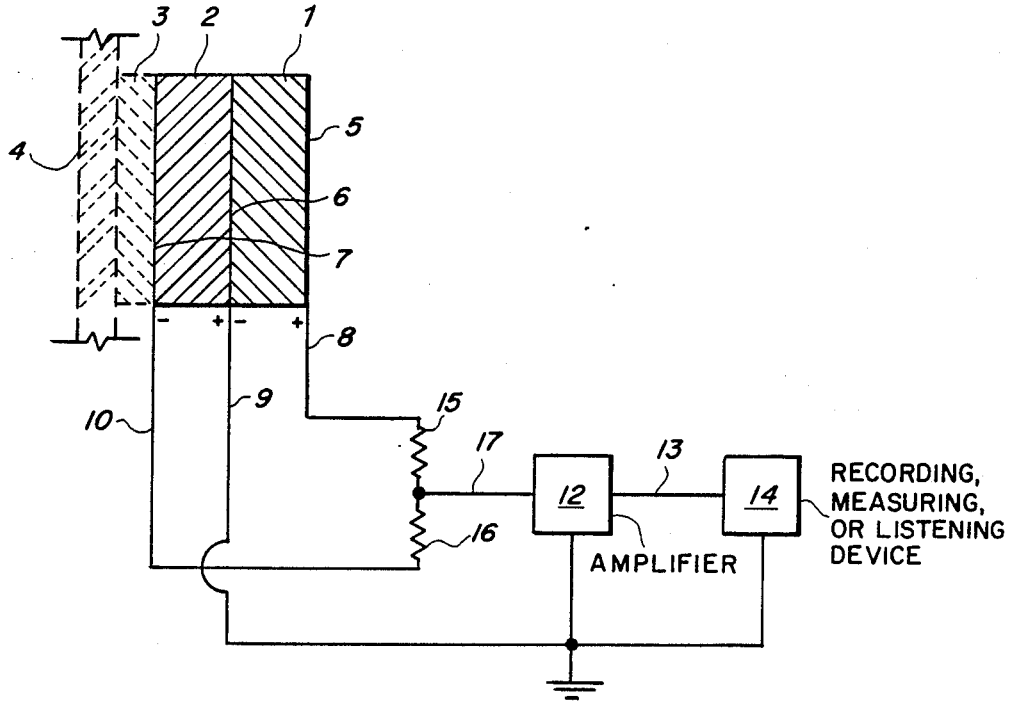
FIG. 2*a* is a schematic view of a second embodiment of this invention.

In a somewhat different embodiment of this invention, illustrated by FIG. 2*a*, the two transducers 1 and 2 are disposed between the electrodes 5, 6, and 7 with equal orientation as to polarity. For example, the negative side of the porous transducer 1 and the positive side of the solid transducer 2 are connected to electrode 6. Alternatively, the polarities of both transducers may be reversed simultaneously.

In this embodiment of the invention, lead 9 is grounded and leads 8 and 10 are connected to two resistors 15 and 16, both having substantially equal resistances. These resistors are further connected to a lead 17 which connects to the input of an amplifier 12, whose output in turn is transmitted via lead 13 to a recording, measuring or listening device 14.

Figure 2B:
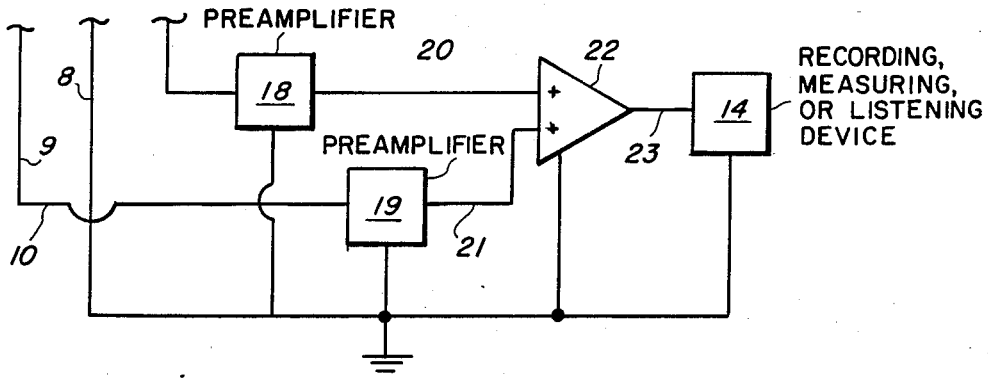
FIG. 2*b* is a schematic view of a variation of the second embodiment of this invention.

In a further variation of the second embodiment of this invention, illustrated by FIG. 2*b*, leads 8 and 10 are connected to the inputs of two optional preamplifiers 18 and 19, whose outputs in turn are transmitted by leads 20 and 21 to the inputs of an operational amplifier 22. Its output connects via lead 23 to a recording, measuring or listening device 14.

In the two variations of this second embodiment, the shipboard noise transmitted to the transducers via the mounting structure 3 produces at electrodes 5 and 7, and hence at leads 8 and 10, substantially equal voltage signals of opposite polarity, which cancel each other, after being added in the case illustrated by FIG. 2*a*, by a resistor network, and in the case illustrated by FIG. 2*b*, by an operational amplifier.

While there have been described what are at present considered to be the preferred embodiments of the invention, it will be obvious to those skilled in the art that various changes and modifications may be made therin without departing from the invention and it is therefore intended to cover all such modifications and changes as fall within the spirit and scope of the invention.

What is claimed is:

1. A hydrophone system having a hydrophone mounted under water on the outside of the hull of a ship, and associated apparatus on board ship, for detecting acoustic sound signals transmitted under water, said hydrophone system comprising:

a flat solid transducer having one of its flat surfaces affixed on a mounting structure fastened to the hull, and having piezoelectric sensitivity to noise generated by the ship and transmitted to the transducer through said mounting structure, said flat solid transducer generating a first voltage signal proportional to the piezoelectric sensitivity of said flat solid transducer to said mount-transmitted ship noise;

a flat void-containing transducer having one of its flat surfaces in contact with the other surface of the solid transducer, said void-containing transducer having piezoelectric sensitivity to both mount-transmitted ship noise and to hydrostatic acoustic signals, said flat void-containing transducer generating a second voltage signal proportional to the piezoelectric sensitivity of said flat void-containing transducer to both said mount-transmitted ship noise and said hydrostatic acoustic signals;

a first electrode disposed on an outer surface of the void-containing transducer, a second electrode interposed between the void-containing transducer and the solid transducer, and a third electrode disposed on the surface of the solid transducer facing toward the hull of the ship, said first voltage signal appearing between said second and third electrodes and said second voltage signal appearing between said first and second electrodes; and detecting means on board ship electrically connected to said electrodes and being responsive to said voltage signals generated in response to mount-transmitted ship noise and to acoustic signals for generating electrical representations of sound signals relatively free of mount-transmitted ship noise.

2. A hydrophone system in accordance with claim 1 wherein the solid transducer is a solid ceramic and the void-containing transducer is a ceramic having regularly-spaced voids of uniform size.

3. A hydrophone system in accordance with claim 1 wherein the detecting means are measuring means.

4. A hydrophone system in accordance with claim 1 wherein the detecting means are recording means.

5. A hydrophone system in accordance with claim 1 wherein the detecting means are means for converting said voltage signals to sound.

6. A hydrophone system in accordance with claim 1 wherein the detecting means further includes an amplifier.

7. A hydrophone system in accordance with claim 1 wherein the transducers are made of ceramics selected from the group consisting of lead zirconate/titanate having the general formula $PbO(ZrO_2)_x(TiO_2)_{(1-x)}$, wherein x ranges from 0.5 to 0.54; lead zirconate/titanate doped with lanthanum oxide, $La_2O_3$, to the extent of 6–15 percent by weight; barium titanate; lead oxide, zinc oxide and niobium oxide in approximately 1:1:1 molar ratio; and an electrostrictive ceramic consisting of lead oxide, magnesium oxide and niobium oxide having the formula $PbO(MgO)_{0.33}(Nb_2O_5)_{0.33}$.

8. A hydrophone system in accordance with claim 1 having a first electrical lead connected to said first electrode, a second electrical lead connected to said second electrode, and a third electrical lead connected to said third electrode, for carrying electrical signals to detecting means on board ship for sensing and amplifying voltage signals across said first, second and third electrical leads and for measuring, recording, and converting said voltage signals to sound.

9. A hydrophone system according to claim 8 in which said third lead is connected to ground, said first lead is connected to the input of an amplifier having an output, said output being connected to means for measuring, recording and converting voltage signals to sound

10. A hydrophone system according to claim 8 in which said second lead is connected to ground, said first lead is connected to a first resistor, said third lead is connected to a second resistor, said first and second resistors having approximately equal resistances and being further connected to a fourth lead connecting to the input of an amplifier, said amplifier having an output connecting to means for measuring, recording and converting voltage signals to sound.

11. A hydrophone system according to claim 8 in which said second lead is connected to ground, said first lead is connected to a first input to an operational amplifier, said third lead is connected to a second input to said operational amplifier, and the output of said operational amplifier connects to said means for measuring, recording and converting voltage signals to sound.

12. An electromechanical transducer system comprising a solid flat plate of piezoelectric ceramic material and a void-containing flat plate of piezoelectric ceramic material firmly bonded to said solid flat plate along the major surface of each plate, electrodes attached to the free major surfaces of the two plates, and an electrode embedded between the two plates, for generating voltage signals in response to mechanical vibrations and compressive stresses, said plates consisting of piezoelectric ceramics selected from the group consisting of lead zirconate/titanate having the general formula $PbO(ZrO_2)_x(TiO_2)_{(1-x)}$, wherein x ranges from 0.5 to 0.54; lead zirconate/titanate doped with lanthanum oxide, $La_2O_3$, to the extent of 6–15 percent by weight; barium titanate; lead oxide, zinc oxide and niobium oxide in approximately 1:1:1 molar ratio; and an electrostrictive ceramic consisting of lead oxide, magnesium oxide and niobium oxide having the formula $PbO(MgO)_{0.33}(Nb_2O_5)_{0.33}$.

* * * * *